US007221351B2

(12) United States Patent
Senda

(10) Patent No.: US 7,221,351 B2
(45) Date of Patent: May 22, 2007

(54) DISPLAY DEVICE

(75) Inventor: Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 414 days.

(21) Appl. No.: 10/444,068

(22) Filed: May 23, 2003

(65) Prior Publication Data

US 2004/0036683 A1 Feb. 26, 2004

(30) Foreign Application Priority Data

May 23, 2002 (JP) ..... 2002-148617

(51) Int. Cl.
*G09G 3/30* (2006.01)
*G09G 3/36* (2006.01)

(52) U.S. Cl. ..... 345/92; 345/76; 345/77

(58) Field of Classification Search ..... 345/55–100, 345/214; 315/169.3
See application file for complete search history.

(56) References Cited

U.S. PATENT DOCUMENTS 4,712,091 A 12/1987 Schoofs et al.
5,691,783 A * 11/1997 Numao et al. ..... 345/92
6,115,017 A * 9/2000 Mikami et al. ..... 345/92
6,518,941 B1 * 2/2003 Kimura ..... 345/92
6,765,560 B1 7/2004 Ozawa
2002/0021274 A1 2/2002 Koyama et al.
2002/0036604 A1 * 3/2002 Yamazaki et al. ..... 345/76
2002/0101394 A1 * 8/2002 Anzai ..... 345/76

* cited by examiner

*Primary Examiner*—Lun-Yi Lao
*Assistant Examiner*—David L. Lewis
(74) *Attorney, Agent, or Firm*—Morrison & Foerster LLP

(57) ABSTRACT

A current generating circuit, which generates a driving current weighed corresponding to a digital image signal, is disposed for each pixel in the display device of this invention. The driving current is supplied to an organic El element. The current generating circuit has D/A conversion function, which is capable of converting the digital image signal into the weighed driving current, enabling the gradation display corresponding to the digital image signal.

12 Claims, 5 Drawing Sheets

$$V=\frac{R'}{R+R'}\times Vps$$

DISPLAY DEVICE

BACKGROUND OF THE INVENTION

1. Field of the Invention

This invention relates to a display device, especially to a display device with a DA conversion function converting a digital image signal into an analog image signal.

2. Description of the Related Art

An electroluminescent (referred to as EL hereinafter) display device with an EL element has been gathering attention as a display device substituting a CRT or an LCD. The development effort for the EL display device with a thin film transistor (referred to as TFT hereinafter) as a switching element for driving the EL element has been made accordingly.

FIG. 7 is an equivalent circuit diagram of a pixel of an organic EL display panel. A gate signal line 50 supplying a gate signal Gn and a drain signal line 60 supplying a drain signal, a video signal Dm, cross each other. The video signal Dm is produced by sampling a video signal by using a sampling signal.

An organic EL element 120, a TFT 100 for driving the organic El element 120, and a TFT 110 for selecting the pixel are disposed near the crossing of the signal lines.

A positive source voltage PVdd is applied to the drain 100*d* of the driving TFT 100 of the organic EL element. And the source 100*s* is connected to an anode 121 of the organic EL element 120.

The gate 110*g* of the TFT 110 for selecting pixel is provided with the gate signal Gn by being connected to the gate signal line 50, and provided with the video signal Dm by being connected to the drain signal line 60. The source 110*s* of the TFT 110 is connected to the gate 100*g* of the TFT 100. The gate signal Gn is generated from a gate driver circuit (not shown in the figure). The video signal Dm is outputted from a drain driver circuit (not shown in the figure).

The organic EL element 120 includes the anode 121, a cathode 122 and an emissive layer 123 inserted between the anode 121 and the cathode 122. The cathode 122 is provided with a negative source voltage CV.

A storage capacitance element 130 is connected to the gate 100*g* of the TFT 100. That is, one of the electrodes of the storage capacitance element 130 is connected to the gate 100*g*, and the other electrode is connected to a storage capacitance electrode 131. The storage capacitance element 130 is disposed in order to keep the video signal of the pixel for one field period by keeping the charge corresponding to the video signal Dm.

The operation of the display device with the above configuration is as follows. The TFT 110 turns on when the gate signal Gn becomes a high level for one horizontal period. Then the video signal Dm is supplied from the drain signal line 60 to the gate 100*g* of the TFT 100 through the TFT 110. The conductance of the TFT 100 changes according to the video signal supplied to the gate 100*g* and the corresponding driving electric current is supplied to the organic EL element 120 through the TFT 100, which results in an illumination of the organic EL element 120.

An analog image signal inputted to the drain signal line 60 is obtained by converting the inputted digital image signal into the analog image signal by a D/A converter. Conventional display devices with a D/A converter built inside the display panel usually have the D/A converter near the driver circuit disposed in the peripheral area of the pixels.

However, since the D/A converter is disposed near the driver circuit, the conventional display device has complicated circuit designs in the peripheral area of the pixels, leading to an enlarged framing area of the display panel to accommodate the D/A converter.

SUMMARY OF THE INVENTION

The invention provides a display device that includes a plurality of pixels. Each of the pixels includes an emissive element emitting a light in response to a digital signal and an electric current generating circuit generating a driving current corresponding to the digital signal and applying the driving current to the emission element.

The invention also provides an electroluminescent display device that includes a plurality of drain signal lines, a driving signal source and a plurality of pixels. Each of the drain signal lines is provided with a corresponding bit of a digital signal. Each of the pixels includes a plurality of pixel selection transistors collectively selecting a pixel in response to a scanning signal, an electroluminescent element and a plurality of driving transistors. Each of the pixel selection transistors connects the corresponding drain signal line and a gate of the corresponding driving transistor. Each of sources of the driving transistors receives a driving signal from the driving signal source. The driving capacity of each of the driving transistors is weighed based on the corresponding bit of the digital signal. The driving transistors collectively supply a driving current to the electroluminescent element.

The invention further provides an electroluminescent display device that includes a plurality of drain signal lines, a driving signal source and a plurality of pixels. Each of the drain signal lines is provided with a corresponding bit of a digital signal. Each of the pixels includes a plurality of pixel selection transistors collectively selecting a pixel in response to a scanning signal, an electroluminescent element, a plurality of driving transistors and a plurality of resistance elements. Each of the pixel selection transistors connects the corresponding drain signal line and a gate of the corresponding driving transistor. Each of sources of the driving transistors receives a driving signal from the driving signal source. The driving transistors collectively supply a driving current to the electroluminescent element. Each of the resistance elements connects the driving signal source and the corresponding driving transistor and has a resistance weighed based on the corresponding bit of the digital signal.

DESCRIPTION OF THE INVENTION

Figure 1:
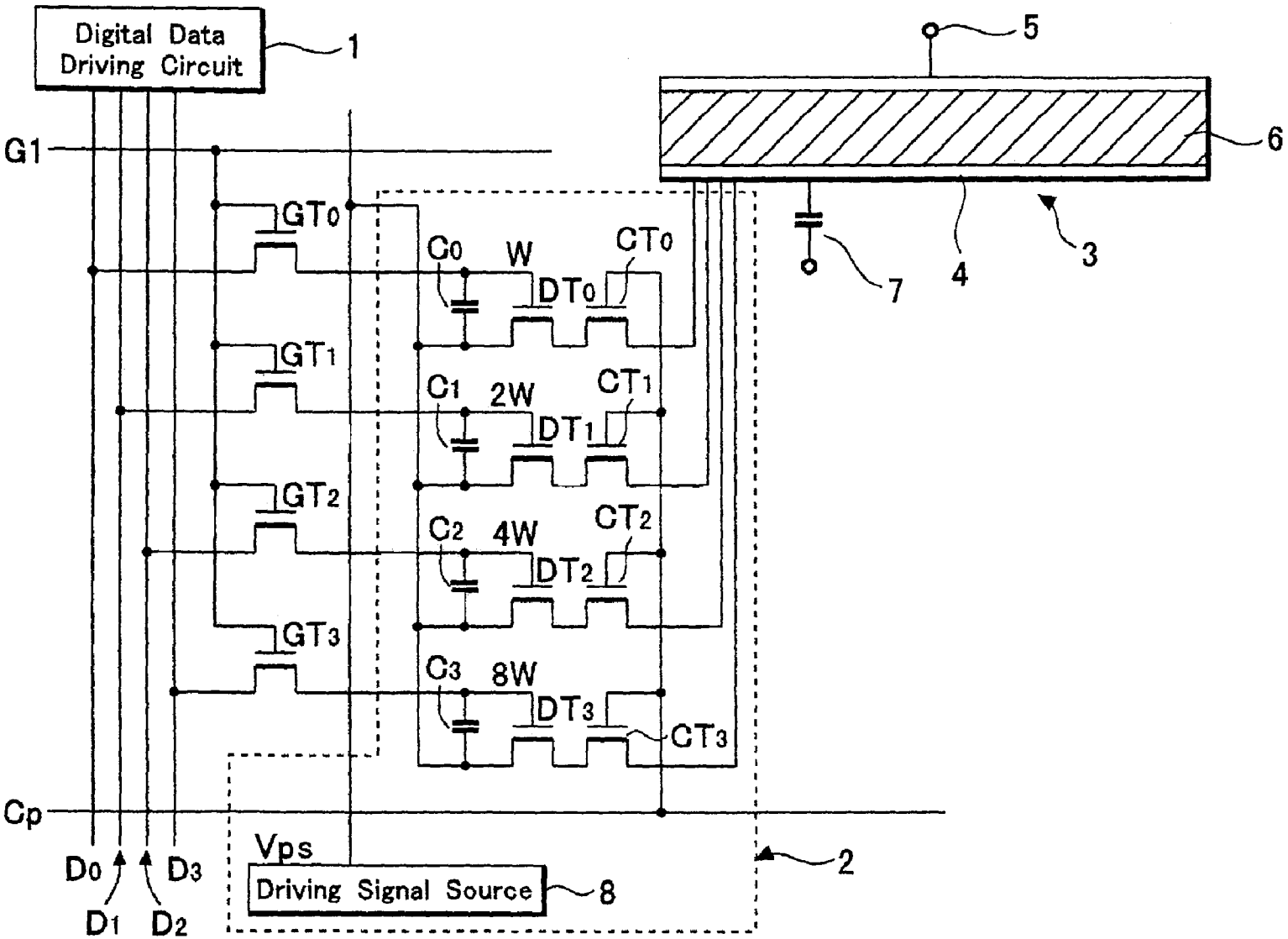
FIG. 1 is a circuit diagram of a display device of a first embodiment of this invention.

A first embodiment of this invention will be explained by referring to FIGS. 1–5. FIG. 1 is a circuit diagram of a display device of the first embodiment of this invention. Only one pixel is shown in the figure for the sake of simplicity, but a plurality of pixels are disposed in a matrix configuration in an actual display device.

A gate signal line G1 is disposed in one direction on an insulating substrate (not shown in the figure). A scanning signal is supplied to the gate signal line G1 from a gate driver (not shown in the figure). Four drain signal lines D0–D3 are disposed in the direction perpendicular to the gate signal line G1. A digital data driving circuit 1 outputs a 4-bit digital image signal corresponding to a sampling signal.

Each bit of the digital image signal (n3, n2, n1, n0) is outputted to the drain signal lines D0–D3 respectively. That is, the drain signal line D0 receives the lowest bit n0, and the drain signal line D3 receives the highest bit n3.The amplitude of the digital image signal can be expressed as (n3·V1, n2·V1, n1·V1, n0·V1) when the voltage signal is V1. Here, n0–n3 are binary data of 0 or 1.

A display with a multiple level gradation is possible by increasing the number of the bits of the digital image signal. On the other hand, a display with a low gradation can be made by decreasing the number of the bits of the digital image signal.

N-channel type pixel selection transistors GT0–GT3 are connected to the drain signal lines D0–D3 respectively. The gate signal line G1 is connected to all gates of the pixel selection transistors GT0–GT3. The term "transistor" in this embodiment represents a TFT.

The digital image signal (n3·V1, n2·V1, n1·V1, n0·V1) is supplied to the current generating circuit 2 through the pixel selection transistors GT0–GT3. The current generating circuit 2 is the circuit for generating the driving current corresponding to the digital image signal (n3·V1, n2·V1, n1·V1, n0·V1). The driving current is supplied to an organic EL element 3. The organic EL element includes an anode 4, a cathode 5 and an emission 6, which is made of organic material and is inserted between the anode 4 and the cathode 5. The reference numeral 7 indicates a parasitic capacitance connected to the anode 4.

The current generating circuit 2 has the following configurations: four N-channel type driving transistors DT0–DT3, the gates of which receive the corresponding bits of the digital image signal (n3·V1, n2·V1, n1·V1, n0·V1), respectively, for switching; a driving signal source 8 for outputting a driving signal Vps that is applied to the driving transistors DT0–DT3; and four coupling capacitors C0–C3 connected between the driving signal source 8 and the driving transistors DT0–DT3. These four coupling capacitors C0–C3 are disposed for ascending the gate voltage when the driving transistors DT0–DT3 turn on, as described below.

Also, four N-channel type timing controlling transistors CT0–CT3 are disposed for controlling the timing when to feed the driving current generated from the driving transistors DT0–DT3 to the organic El element 3.

The driving current generated from each of the driving transistors DT0–DT3 is fed to the organic EL element 3 through the timing controlling transistors CT0–CT3. Therefore, the sum of the driving current generated from each of the driving transistors DT0–DT3 is applied to the organic EL element 3.

The current driving capacity of each of the driving transistors DT0–DT3 is weighed according to each of the bits of the digital image signal (n3·V1, n2·V1, n1·V1, n0·V1) as described below.

It is known that the current driving capacity of the driving transistors DT0–DT3 is in proportion to GW/(GL·Tox), where GW is the width of the gate, GL is the length of the channel, and Tox is the thickness of the gate insulating film. Therefore, weightd can be added by adjusting the width of the gate. For example, the gate width GW1 of the driving transistor DT1 should be 2W, the gate width GW2 of the driving transistor DT2 should be 4W, and the gate width GW3 of the driving transistor DT3 should be 8W, assuming that the gate width GW0 of the driving transistor DT0 is W.

Figure 2:
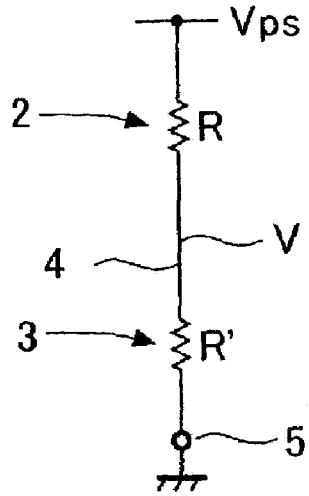
FIG. 2 is an equivalent circuit diagram of the electric current generating circuit and the organic EL element of the display device of FIG. 1.

FIG. 2 shows the equivalent circuit diagram of the current generating circuit 2 and the organic EL element 3, in which the total resistivity of the driving transistors DT0–DT3 is R, and the resistivity of the organic EL element is R'. The voltage V generated between the anode 4 and the cathode 5 of the organic EL element 3 is expressed by the following equation obtained from the equivalent circuit in shown FIG. 2:

$$V=Vps\times R'/(R+R') \tag{1}$$

The voltage of the cathode 5 is 0V.

On the other hand, the total resistivity R of the driving transistors DT0–DT3 is approximately expressed as follows:

$$1/R=(n0/8r+n1/4r+n2/2r+n3/r) \tag{2}$$

Here, r denotes the on-resistance of the driving transistor DT3. Also, the on-resistance of the timing controlling transistors CT0–CT3 is minimal compared to the on-resistance of the driving transistor DT0–DT3.

Therefore, the resistivity R corresponding to the bit data of the digital image signal (n3, n2, n1, n0) should be infinite when the bit data is (0, 0, 0, 0), 8r when the bit data is (0, 0, 0, 1), 4r when the bit data is (0, 0, 1, 0,), and 8/3·r when the bit data is (0, 0, 1, 1), 2r when the digital data is (0, 1, 0, 0) . . . , and 8/15·r when the digital data is (1, 1, 1, 1). The off-resistance of the driving transistors DT0–DT3 is approximately infinite.

Figure 3:
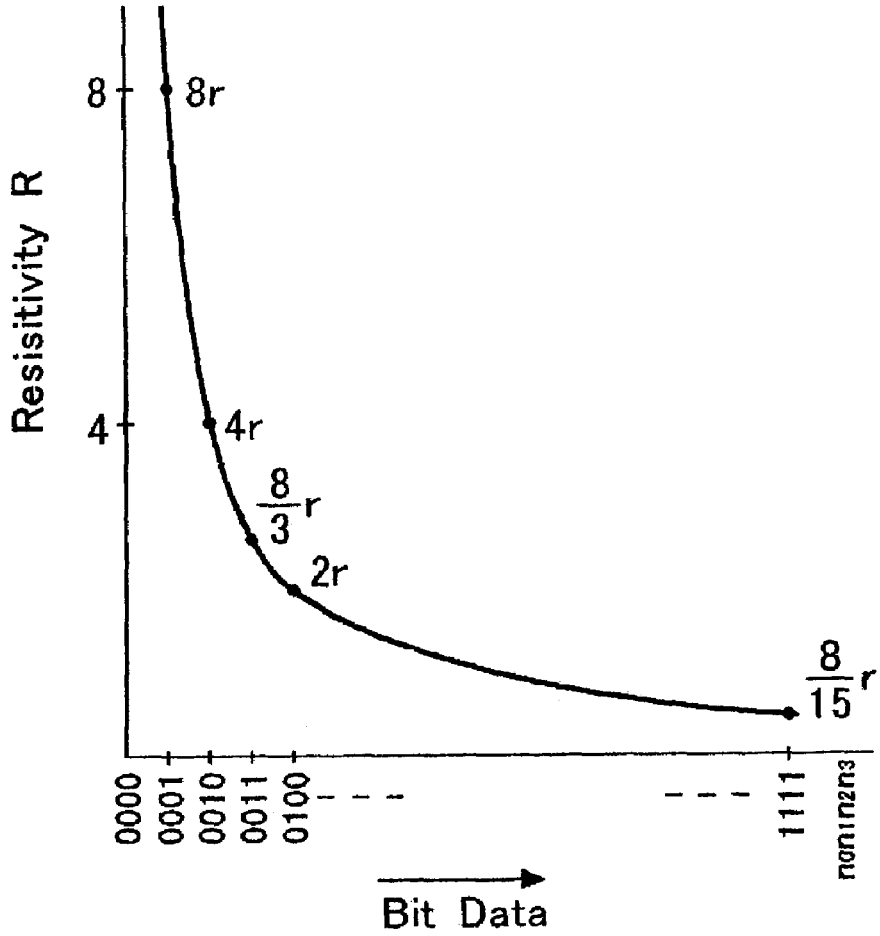
FIG. 3 shows the resistance of the driving transistors shown in FIG. 1 as a function of the bit level of a digital image signal.

The change of the resistivity is shown in FIG. 3. The x-axis shows the bit data (n3, n2, n1, n0) and the y-axis shows the resistivity R in the figure. As the bit data (n3, n2, n1, n0) of the digital image signal increases, the total resistivity R decreases, as seen from the figure.

Figure 4:
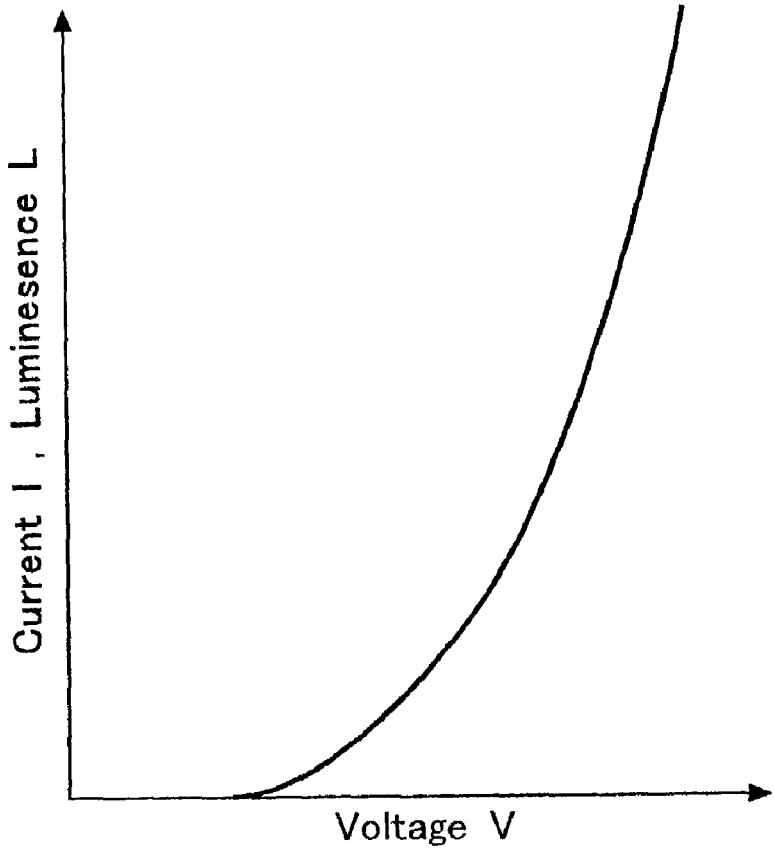
FIG. 4 shows the driving current and the luminescence of the organic El element shown in FIG. 1 as a function of a voltage.

The voltage V applied to the organic EL element 3 increases as the bit data (n3, n2, n1, n0) increases according to the equation (1) described above. When the voltage V applied to the organic EL element 3 increases, the driving current I going through the organic EL element 3 from the driving transistors DT0–DT3 also increases, leading to the increased luminescence L of the organic EL element 3. FIG. 4 shows the driving current I and the luminescence L of the organic EL element 3 as a function ot the voltage V.

Therefore, the luminescence L of the organic EL element 3 can be controlled in steps by feeding the driving current I to the organic EL element 3 according to the digital image signal in the display device with the above configuration. In other words, a D/A conversion function is built in the pixel for converting the digital image signal into the driving current I, making the gradation display possible.

Figure 5:
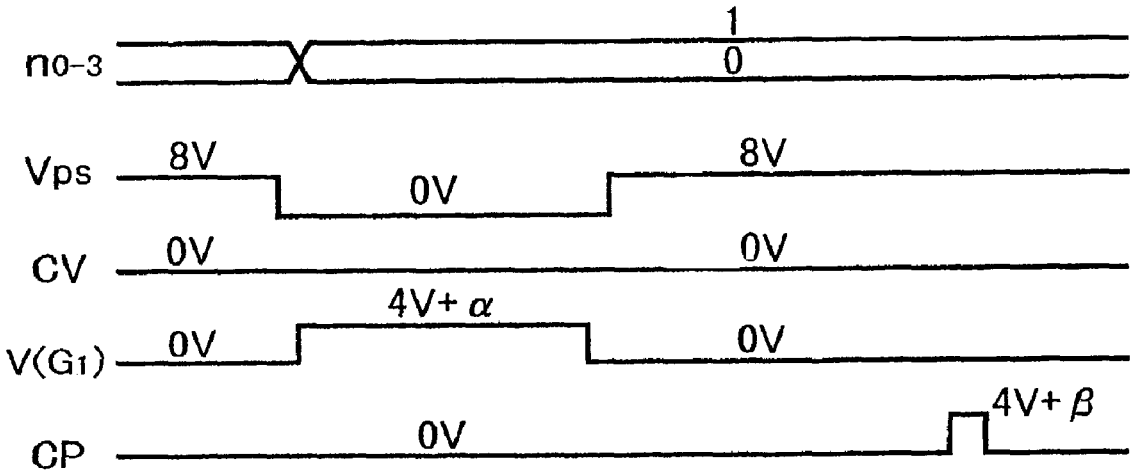
FIG. 5 is a timing chart of an operation of the display device of the first embodiment.

The operation of the display device with the above configuration will be explained by referring to FIG. 5. The driving signal Vps outputted from the driving signal source 8 is 8V before the pixel is selected, and this voltage 8V is fed to the sources of the driving transistors DT0–DT3. The sources of the driving transistors DT0–DT3 are set to be 0V when the driving signal Vps changes from 8V to 0V. Next, the voltage V (G1) of the gate signal line G1 becomes 4V+α, where α is the voltage larger than the threshold voltage of the pixel selection transistors GT0–GT3.

Then, the pixel selection transistors GT0–GT3 turn on, and each bit of the digital image signal (n3, n2, n1, n0) is read from the drain signal lines D0–D3. This makes the voltage of the gate of the driving transistor DT0 n0×4V, the voltage of the gate of the driving transistor DT1 n1×4V, the voltage of the gate of the driving transistor DT2 n2×4V, and the voltage of the gate of the driving transistor DT3 n3×4V.

Next, the voltage V (G1) of the gate signal line G1 becomes 0V. And this makes the pixel selection transistors GT0–GT3 turn off. Then, the voltage of the driving signal Vsp changes from 0V to 8V. The voltage of the gate of the driving transistor DT0–DT3 increases by 8V due to the coupling capacitors C0–C3. But, this is only the case when the parasitic capacitance that is formed, for example, between the gate and the drain of the driving transistors DT0–DT3 is ignored.

The voltage of the driving transistor DT0 becomes n0×4V+8V. That is, the voltage of the gate is 8V when n0 is "0". In this case, the driving transistor DT0 turns off. On the other hand, when n0 is "1", the voltage of the gate becomes about 12V, enough to turn on the driving transistor DT0. The same applies to the other driving transistors DT1–DT3. Since the coupling capacitors C0–C3 are utilized for ascending the voltage of the driving transistors DT0–DT3 as described above, it is possible to suppress the amplitude of the digital image signal.

The driving transistors DT0–DT3 switch according to the corresponding bits of the digital image signal (n3, n2, n1, n0), determining the total resistivity of the driving transistors DT0–DT3 based on the equation (2).

Then, the timing controlling transistors CT0–CT3 turn on when the timing controlling signal CP becomes 8V+β. Here, β is a voltage larger than the threshold voltage of the timing controlling transistors CT0–CT3. The electric current I goes through the timing controlling transistors CT0–CT3 from the driving transistors DT0–DT3, and is applied to the organic EL element 3 that emits light with the luminescence corresponding to the driving current I.

The timing controlling transistors CT0–CT3 turn off when the timing controlling signal CP becomes 0V. The supply of the driving current I to the organic El element 3 stops, making the organic EL element 3 stop emitting light.

The timing controlling transistors CT0–CT3 are formed in this embodiment for adjusting the timing for the driving current I through the organic EL element 3. The timing controlling transistors are formed only when the above configuration is required. Each drain of the driving transistors DT0–DT3 should be connected directly to the organic EL element 3, when the timing controlling transistors CT0–CT3 are not necessary.

Although the coupling capacitors C0–C3 are formed for ascending the gate voltage when the driving transistors DT0–DT3 turn on, it is also possible to omit the coupling capacitance. In this case, however, the amplitude of the digital image signal should be large. The number of the bits of the digital image signal (n3, n2, n1, n0) is not limited to four. The smaller or larger number of the bits is also possible for the digital image signal.

The weight is added to the current driving capacity of the driving transistors DT0–DT3 by adjusting the gate width of the driving transistors DT0–DT3. However, it is also possible to add the weight by adjusting the channel length GL or adjusting the film thickness Tox of the gate insulating film.

Next, a second embodiment of this invention will be explained by referring to FIG. 6, which is a circuit diagram of the second embodiment. Only one pixel is shown in the figure for the sake of simplicity. But a plurality of the pixels are disposed in a matrix configuration in an actual display device. The same components as in the first embodiment are give the same reference numerals in this embodiment.

A resistance element is connected in series to each of the driving transistors DT0–DT3 in this embodiment. The resistivity of these resistance elements is weighed according to the corresponding bit of the digital image signal (n3. n2, n1, n0).

Figure 6:
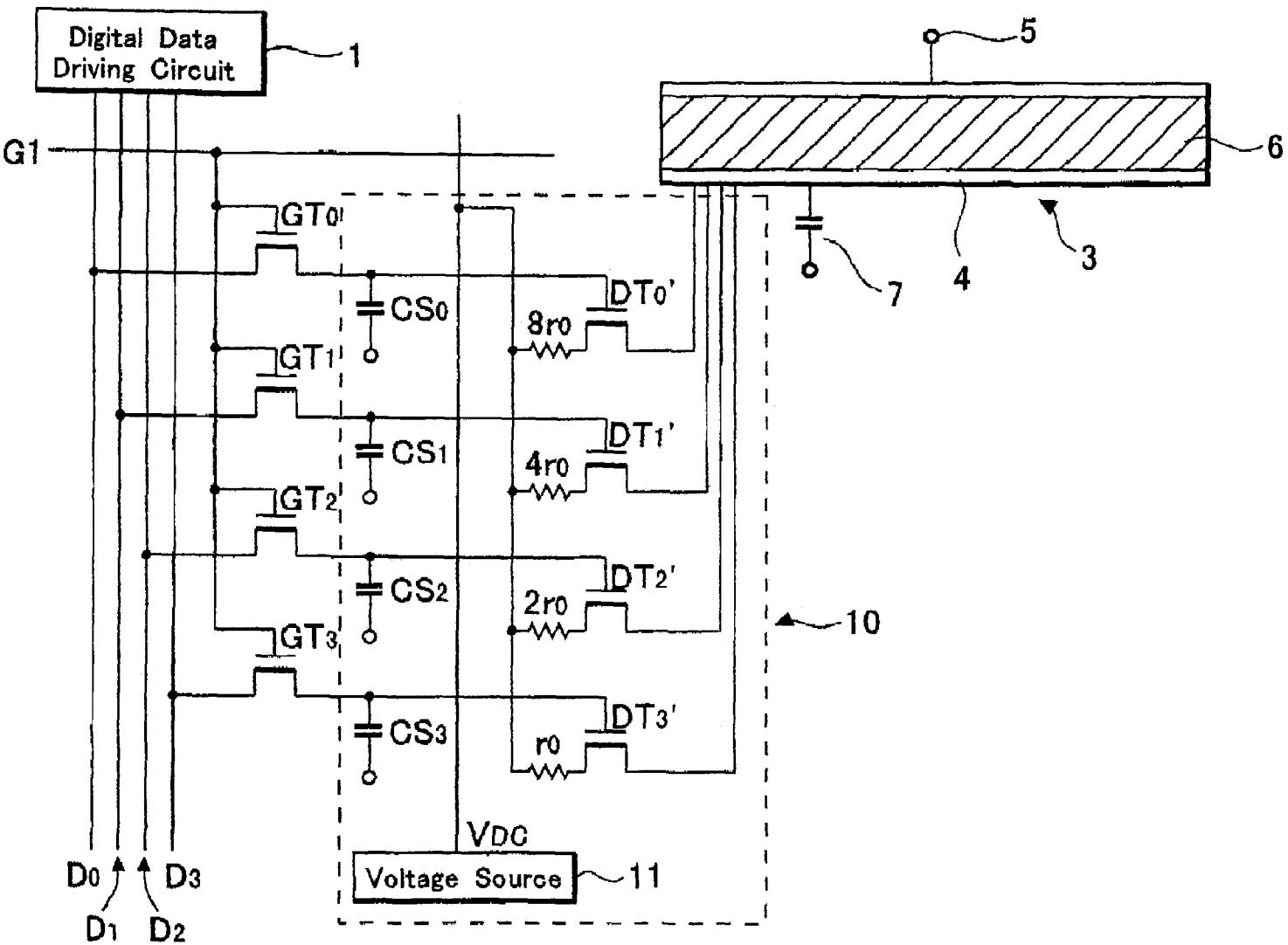
FIG. 6 is a circuit diagram of a display device of a second embodiment of this invention.
Figure 7:
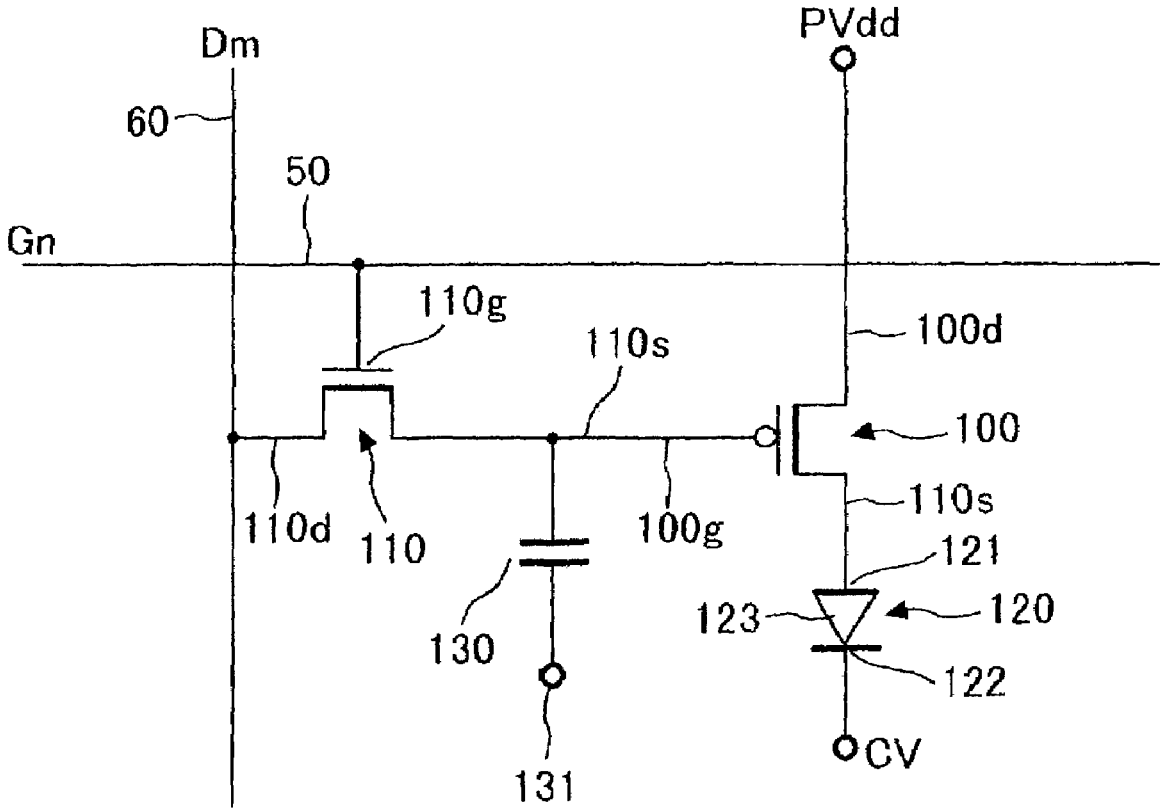
FIG. 7 is an equivalent circuit diagram of a pixel of a conventional organic EL display device.

The current generating circuit 10 in FIG. 6 has the following configuration. Four N-channel type driving transistors DT0'–DT3', to the gates of which the corresponding bits of the digital image signal (n3·V1, n2·V1, n1·V1, n0·V1) are applied for switching. Here, the voltage V1 is the signal amplitude (for example, 8V+α).

Also, a driving voltage source 11 outputs the direct current driving voltage VDC (for example 8V) and supplies it to the sources of the driving transistors DT0'–DT3'. Resistance elements, which have the resistivity of 8r0, 4r0, 2r0 and r0, respectively, are connected between the output of the driving voltage source 11 and the driving transistors DT0'–DT3', respectively.

Also, storage capacitance elements CS0–CS3 for holding the digital image signal are connected to the gates of the driving transistors DT0'–DT3'.

The equivalent circuit diagram of the current generating circuit 10 and the organic EL element 3 is the same as the circuit diagram shown in FIG. 2 assuming that the total resistivity of the driving transistors DT0'–DT3' is R and that the resistivity of the organic EL element 3 is R'. The voltage V generated between the anode 4 and the cathode 5 of the organic EL element 3 is expressed as the equation (3) obtained from the above equivalent circuit.

$$V=VDC\times R'/(R+R') \tag{3}$$

The voltage of the cathode 5 is 0V.

The total resistivity of the driving transistors DT0'–DT3' can be expressed approximately as follows:

$$1/R=(n0/8r0+n1/4r0+n2/2r0+n3/r0) \tag{4}$$

Here, the on-resistance of the driving transistors DT0'–DT3' is small enough compared to the resistivity r.

Therefore, the resistivity R corresponding to the bit data of the digital image signal (n3, n2, n1, n0) should be infinite when the bit data is (0, 0, 0, 0), 8r0 when the bit data is (0, 0, 0, 1), 4r0 when the bit data is (0, 0, 1, 0,), and 8/3·r0 when the bit data is (0, 0, 1, 1), 2r0 when the digital data is (0, 1, 0, 0) . . . , and 8/15·r0 when the digital data is (1, 1, 1, 1), as is the case with the first embodiment. The off-resistance of the driving transistors DT0'–DT3' is approximately infinite.

The voltage V applied to the organic EL element 3 increases as the bit data (n3, n2, n1, n0) increases as in the first embodiment. When the voltage V applied to the organic El element 3 increases, the driving current I going through the organic El element 3 from the driving transistors DT0'–DT3' also increases, leading the increased luminescence L of the organic EL element 3. Therefore, the luminescence L of the organic EL element 3 can be controlled in steps by feeding the driving current I to the organic EL element 3 according to the digital image signal in the display device of this embodiment.

The operation of the display device with the above configuration will be explained. The threshold voltage of the driving transistors DT0'–DT3' and the pixel selection transistors GT0–GT3 is ignored to make the explanation simple.

The voltage V (G1) of the gate signal line G1 becomes 8V. Then, the pixel selection transistors GT0–GT3 turn on, and each bit of the digital image signal (n3, n2, n1, n0) is read into from the drain signal lines D0–D3. This makes the voltage of the gate of the driving transistor DT0' n0×8V, the voltage of the gate of the driving transistor DT1' n1×8V, the voltage of the gate of the driving transistor DT2' n2×8V, and the voltage of the gate of the driving transistor DT3 n3×8V.

The voltage of the gate is 0V when n0 is "0" as to the driving transistor DT0', turning the driving transistor DT0' off. On the other hand, when n0 is "1", the voltage of the gate becomes 8V, turning the driving transistor DT0' on. The same applies to the other driving transistors DT1'–DT3'.

The driving transistors DT0'–DT3' switch according to the corresponding bits of the digital image signal (n3, n2, n1, n0), determining the total resistivity of the driving transistors DT0–DT3 based on the equation (2). The driving current I is applied to the organic EL element 3 through the driving transistors DT0'–DT3', and the organic EL element 3 emits light with the luminescence corresponding to the driving current I.

The timing controlling transistors CT0–CT3 for adjusting the timing of the driving current I through the organic EL element 3 are omitted in this embodiment. However, the timing controlling transistors can be formed as in the first embodiment. The number of the bits of the digital image signal (n3, n2, n1, n0) is not limited to four. The smaller or larger number of bits is also possible for the digital image signal.

The embodiments ate applied to the display device with the organic EL element 3, but are not limited to the EL devices. The features of these embodiments are applicable to any display device with a current driven emission element such as LED.

What is claimed is:

1. A display device comprising a plurality of pixels, at least one of the pixels comprising:

an emissive element emitting a light in response to a collectively applied driving current; and an electric current generating circuit comprising a plurality of driving transistors, each driving transistor corresponding to a different bit of a digital signal and generating a driving current based on the corresponding bit of the digital signal, the driving transistors collectively applying the driving currents to the emissive element, and a plurality of timing controlling transistors being disposed between corresponding driving transistors and the emissive element; and a plurality of pixel selection transistors, each pixel transistor being connected between a corresponding driving transistor and a corresponding drain line.

2. The display device of claim 1, further comprising a driving signal source, wherein each of the driving transistors switches according to a corresponding bit of the digital signal and has a driving capacity weighted based on the corresponding bit of the digital signal, and the driving signal source supplies a driving signal to the driving transistors.

3. The display device of claim 2, wherein the electric current generating circuit further comprises a plurality of coupling capacitors, each of the coupling capacitors connecting the driving signal source and a gate of the corresponding driving transistor.

4. The display device of claim 1, wherein the timing controlling transistors collectively supply the driving currents to the emissive element at a timing controlled by the timing controlling transistors.

5. The display device of claim 1, further comprising a driving signal source and a plurality of resistance elements, wherein each of the driving transistors switches according to a corresponding bit of the digital signal, the driving signal source supplies a driving signal to the driving transistors, and each of the resistance elements connects the driving signal source and the corresponding driving transistor and has a resistance weighted based on the corresponding bit of the digital signal.

6. An electroluminescent display device comprising:

a plurality of drain signal lines, each of the drain signal lines being provided with a corresponding bit of a digital signal;

a driving signal source; and a plurality of pixels, at least one of the pixels comprising a plurality of pixel selection transistors collectively selecting a pixel in response to a scanning signal, an electroluminescent element and a plurality of driving transistors, each of the pixel selection transistors connecting the corresponding drain signal line and a gate of the corresponding driving transistor, each of sources of the driving transistors receiving a driving signal from the driving signal source, a driving capacity of each of the driving transistors being weighted based on the corresponding bit of the digital signal, and each of the driving transistors corresponding to a different bit of the digital signal and collectively supplying a driving current to the electroluminescent element, said at least one of the pixels further comprising a plurality of timing controlling transistors disposed between the driving transistors and the electroluminescent element.

7. The electroluminescent display device of claim 6, said at least one of the pixels further comprising a plurality of coupling capacitors, each of the coupling capacitors connecting the driving signal source and the gate of the corresponding driving transistor.

8. The electroluminescent display device of claim 7, wherein the timing controlling transistors collectively supply the driving current at a timing controlled by the timing controlling transistors.

9. The electroluminescent display device of claim 6, the timing controlling transistors collectively supplying the driving current at a timing controlled by the timing controlling transistors.

10. An electroluminescent display device comprising:

a plurality of drain signal lines, each of the drain signal lines being provided with a corresponding bit of a digital signal;

a driving signal source; and a plurality of pixels, at least one of the pixels comprising a plurality of pixel selection transistors collectively selecting a pixel in response to a scanning signal, an electroluminescent element, a plurality of driving transistors, each of the pixel selection transistors connecting the corresponding drain signal line and a.gate of the corresponding driving transistor, each of sources of the driving transistors receiving a driving signal from the driving signal source and each of the driving transistors corresponding to a different bit of the digital signal and collectively supplying a driving current to the electroluminescent element, and a plurality of resistance elements, each of the resistance elements connecting the driving signal source and the corresponding driving transistor and having a resistance weighted based on the corresponding bit of the digital signal, said at least one of the pixels further comprising a plurality of timing controlling transistors disposed between the driving transistors and the electroluminescent element.

11. The electroluminescent display device of claim 10, said at least one of the pixels further comprising a plurality of storage capacitance elements, each of the storage capacitor elements holding the corresponding bit of the digital signal and being connected to the gate of the corresponding driving transistor.

12. The electroluminescent display device of claim 10, wherein the timing controlling transistors collectively supply the driving current at a timing controlled by the timing controlling transistors.

* * * * *